US012714245B2

(12) United States Patent
Perper

(10) Patent No.: US 12,714,245 B2
(45) Date of Patent: Aug. 25, 2026

(54) SHOULDER SUPPORT FOR LATERAL DECUBITUS POSITIONING

(71) Applicant: Yakov Perper, Valley Stream, NY (US)

(72) Inventor: Yakov Perper, Valley Stream, NY (US)

( * ) Notice: Subject to any disclaimer, the term of this patent is extended or adjusted under 35 U.S.C. 154(b) by 313 days.

(21) Appl. No.: 18/406,514

(22) Filed: Jan. 8, 2024

(65) Prior Publication Data

US 2025/0221553 A1 Jul. 10, 2025

(51) Int. Cl.
*A47G 9/10* (2006.01)

(52) U.S. Cl.
CPC ..... *A47G 9/109* (2013.01)

(58) Field of Classification Search
CPC ..... A47G 9/10; A47G 9/1009; A47G 9/1027; A47G 9/1036; A47G 9/1045; A47G 9/1054; A47G 9/1063; A47G 9/1072; A47G 9/1081; A47G 9/109; A47G 2009/1018
See application file for complete search history.

(56) References Cited

U.S. PATENT DOCUMENTS

| | | | | |
|---|---|---|---|---|
| 5,257,429 | A | 11/1993 | Genis | |
| 5,479,667 | A | 1/1996 | Nelson | |
| 6,095,894 | A | 8/2000 | Stevens | |
| D434,936 | S | 12/2000 | May | |
| 6,182,311 | B1 | 2/2001 | Buchanan | |
| 6,289,538 | B1 * | 9/2001 | Fidge | A47C 7/72 5/640 |
| 6,779,211 | B1 | 8/2004 | Williams | |
| 6,973,691 | B1 * | 12/2005 | Cordova | A47C 7/383 5/652 |
| 7,252,330 | B2 | 8/2007 | Lincoln | |
| D561,511 | S | 2/2008 | Peart | |
| 7,441,293 | B1 | 10/2008 | Singer | |
| 7,563,236 | B2 | 7/2009 | Kazmierczak | |
| 8,069,515 | B1 | 12/2011 | Tingey | |
| 8,109,273 | B2 * | 2/2012 | Golden | A61F 5/32 602/5 |
| 8,516,639 | B2 * | 8/2013 | Mobley | A61G 13/121 5/636 |

(Continued)

FOREIGN PATENT DOCUMENTS

| | | |
|---|---|---|
| WO | WO2019/036311 | 2/2019 |

*Primary Examiner* — George Sun
(74) *Attorney, Agent, or Firm* — Thomas P. O'Connell; O'Connell Law Firm

(57) ABSTRACT

A shoulder support structure for stabilizing and supporting a shoulder of an individual in a lateral decubitus position with proximal and distal pillows, each with central, front leg, and rear leg portions that define a reception area for receiving the shoulder and upper torso of the individual. An upper connector couples the central portions of the proximal and distal pillows, and first and second lower connecting straps, which can be adjustable in length, connect the frontal and rear leg portions of the pillows. The distal pillow can be formed into a closed loop by a connector. Retaining straps retain the pillows relative to the shoulder of the individual, whether by encircling the neck and torso of the individual or by coupling the shoulder support formed by the proximal and distal pillows to a second shoulder support likewise formed by proximal and distal pillows.

27 Claims, 10 Drawing Sheets

(56) References Cited

U.S. PATENT DOCUMENTS

| | | | | |
|---|---|---|---|---|
| 9,027,185 | B2 * | 5/2015 | Garcia | B60N 2/882 5/636 |
| 9,326,906 | B2 | 5/2016 | Thanas | |
| 9,408,471 | B2 * | 8/2016 | Higa | A47C 7/383 |
| 9,737,158 | B2 * | 8/2017 | Kreppein | A47C 16/00 |
| 10,178,915 | B1 * | 1/2019 | Sternlight | A47C 7/383 |
| 2007/0033737 | A1 | 2/2007 | Melton | |
| 2008/0301878 | A1 * | 12/2008 | Elhabashy | A61G 13/12 5/646 |
| 2013/0061856 | A1 * | 3/2013 | Khademi | A47C 7/42 128/845 |
| 2015/0059098 | A1 | 3/2015 | Jung | |
| 2015/0173936 | A1 * | 6/2015 | Lowden | A61F 5/3753 128/878 |
| 2015/0257555 | A1 * | 9/2015 | Wong | A47C 7/383 5/636 |
| 2016/0183685 | A1 | 6/2016 | Kang | |
| 2017/0042332 | A1 * | 2/2017 | Atkinson | A47C 7/383 |
| 2017/0065108 | A1 * | 3/2017 | Thorn | A47G 9/1027 |
| 2019/0167020 | A1 * | 6/2019 | Bice | A47G 9/10 |
| 2019/0254435 | A1 * | 8/2019 | Neu | A47C 7/383 |
| 2019/0343307 | A1 * | 11/2019 | Cullins | A47C 7/383 |
| 2020/0390629 | A1 * | 12/2020 | Sifferlin | A61G 13/1215 |
| 2021/0145683 | A1 | 5/2021 | Ortega | |
| 2022/0071417 | A1 * | 3/2022 | Baugh | A61G 7/072 |

* cited by examiner

SHOULDER SUPPORT FOR LATERAL DECUBITUS POSITIONING

FIELD OF THE INVENTION

The present invention relates generally to positioning support devices. More particularly, disclosed herein is a shoulder support for supporting, protecting, and decompressing a user's shoulder when in the lateral decubitus position, such as during sleeping.

BACKGROUND OF THE INVENTION

When a person lies on his or her side in the lateral decubitus position, pressure is created between the support surface, such as a mattress, a pillow, or a surgical table, and the ipsilateral shoulder head. The shoulder head consecutively compresses the structures around it, compressing, for example, the glenohumeral joint. Compression typically results in no permanent harm to a healthy shoulder since the shoulder can adjust and compensate, but it may nonetheless lead to discomfort, such as in the form of soreness and paresthesia where tingling and numbness result from sustained pressure on the nerves within and proximal to the shoulder. However, a deranged shoulder-a shoulder disturbed or disordered in function, structure, or condition-cannot adapt and, as a result, may be harmed.

Over time, compression of the shoulder can contribute to derangement of the multiple, comples shoulder muscles and impingement and compression of the surrounding ligaments, muscles, and nerves. Indeed, downward compression of the shoulder can cause the cervicothoracic spine to become misaligned thereby producing traction and, additionally or alternatively, compression of the neurovascular and soft tissue elements in those areas. The harm deriving from such shoulder compression can lead to the progression of shoulder derangement, including but not limited to rotator cuff tearing, shoulder impingement, limited mobility, and further deleterious effects.

Meanwhile, it is known that the shoulder is among the most complex joints in the human body with a healthy shoulder having the greatest range of motion of any human joint. As shown in FIGS. 8 and 9, the shoulder 102 of a human body 100 is formed with four essential muscles: the supraspinatus 124, the infraspinatus 126, the teres minor 128, and the teres major 130. Those muscles and their associated tendons are collectively referred to as the rotator cuff. The rotator cuff is surrounded by a bursa sac 106 for accommodating movement of the tendons. The deltoid muscle 104 overlies the rotator cuff and gives the shoulder 102 its rounded contour. The labrum 118 is a thick tissue that helps keep the ball of the shoulder joint in place while the scapula 116, also known as the shoulder blade, connects the humerus 112, which is the upper arm bone, with the clavicle 122, often referred to as the collar bone. The humerus 112 terminates in a humeral head 108. The biceps 114 connect to the shoulder and the elbow to flex the elbow and to supinate the forearm, and the lateral and long heads 132 and 134 forming the triceps are responsible for extending the elbow joint and straightening the arm. While elegant in structure and operation, the complex shoulder joint 102 is prone to injury and trauma including bursitis, tendonitis, arthritis, rotator cuff tears, calcification of the joint, subluxation in the form of an instability due to stretched or torn ligaments, dislocation, and actual breakage of the humerus 112, scapula 116, or clavicle 122.

The pain, numbness, discomfort, and potential damage resulting from an improperly supported shoulder, particularly a shoulder that has been injured or that has undergone surgery, disturbs the person's sleep and produces a number of other disadvantageous effects. Pressure on the shoulder 102, particularly the ipsilateral humeral head 108, consecutively compresses the structures around it. It compresses the glenohumeral joint and, over time, causes the derangement of the multiple and complex shoulder muscles, tendons, and nerves. This causes persons with shoulder pain and discomfort to wake frequently as they are forced to change position to relieve the pain and discomfort, even if only temporarily. As a result, sleep quality is diminished. Poor sleep can negatively affect all aspects of everyday life, including mood, problem solving, coordination, and other critical characteristics. Not only may the pain and function of the affected shoulder worsen, but also the affected individual may develop problems related to poor sleep, including short memory loss, fibromyalgia, fatigue, depression, and still further negative results.

Despite the foregoing, many individuals, even those with shoulder damage, sleep on their sides. For instance, many prefer side sleeping as being more comfortable but for the negative aspects referenced above. Others find side sleeping more conducive to falling asleep. Still others may fall asleep in a supine or prone position nevertheless to wake up in the lateral decubitus or lateral recumbent position. Other individuals may seek to sleep on their sides to avoid or minimize sleep apnea. Still further, it has been found that side sleeping contributes to the prevention of Alzheimer's disease. Thus, many will, whether intentionally or unintentionally, find themselves sleeping or resting on their sides.

In view of the negative consequences of side sleeping without adequate shoulder support, numerous solutions have been attempted. Solutions have ranged from ad hoc practices, such as effectively hugging a pillow or selectively positioning a blanket, to dedicated solutions, such as uniquely configured head, neck, and shoulder support pillows and cushions designed to support or cradle the head, neck, or shoulder in various ways in an effort to maintain alignment and comfort and to reduce compression. For instance, with U.S. Pat. No. 9,326,906, Thanas teaches a Therapeutic Pillow for supporting a person's arm and shoulder that has a back section for positioning and supporting the pillow on a support surface and a pair of side arms extending from the back section. Further, International Publication No. WO2019/036311 of Castro discloses an H-shaped pillow structure for side sleepers that is designed to be held against the user's chest during sleeping. Still further, Ortega et al. disclose a Surgery Patient Support Device with U.S. Patent Application Publication No. 2021/0145683 where a main section with an elongate arm void is provided for receiving an upper arm of a patient in the lateral decubitus position.

Unfortunately, the attempts of the prior art at preventing discomfort and damage to the shoulders during side sleeping still leave a plurality of disadvantages. Perhaps most basically, many rely on the presumptions that the individual will remain in the identical position all night long and that the support structure, whether a simple pillow, a blanket, or a particularized support device, will not become dislodged during sleep. However, neither presumption is typically accurate. Most individuals will seek or need to reposition during sleep, whether consciously or unconsciously, and the support structure will often become incorrectly positioned thereby not providing the intended support and perhaps creating even further discomfort and damage. Moreover, many such proposed solutions are not adjustable to the user's particular needs and preferences. For example, a pillow or blanket may be too thick or not thick enough to provide desirable positioning and support, and support structures disclosed by the prior art may provide adequate stabilization to one user while being too substantial or insubstantial for other users. With that, multiple sizes of the devices are required. Moreover, a user's needs may change over time so that a support structure that was once proper becomes inadequate over time.

It is thus apparent that, despite the many attempts at providing stabilization and support to side sleepers, there remains a cognizable need for a shoulder support structure for lateral decubitus positioning that provides comfortable support and positioning, that resists unintentional dislodgment, and that can be adjusted in configuration and effective size to different users and to differing user needs and preferences.

SUMMARY OF THE INVENTION

With an awareness of the needs presented by the human condition and the limitations of the prior art, the present inventor set forth with the basic object of providing a shoulder support structure that comfortably and stably supports the shoulder of a user in the lateral sleeping or resting position.

A further object of the invention is to provide a shoulder support structure that resists inadvertent displacement, including during repositioning of the user.

Another object of embodiments of the invention is to provide a shoulder support structure that can be adjusted in support characteristics to accommodate the sizes, needs, and preferences of individual users.

A related object of the invention in certain embodiments is to provide a shoulder support structure that can be adjusted in effective support dimension to adjust to differing user needs and preferences.

An additional object of the invention is to provide a shoulder support structure that allows individuals to sleep on an injured or sore shoulder in the lateral decubitus position safely and with reduced or eliminated risk of further damage, impingement, or compression.

These and further objects and advantages of the present invention will become obvious not only to one who reviews the present specification and drawings but also to those who have an opportunity to make use of an embodiment of the shoulder support structure disclosed herein. However, it will be appreciated that, while the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth one or more objects of the invention, one embodiment of the shoulder support structure for stabilizing and supporting a shoulder of an individual in a lateral decubitus position comprises a proximal pillow with an upper portion, a lower portion, and a reception area for receiving the shoulder and upper torso of the individual, a distal pillow with an upper portion, a lower portion, and a reception area for receiving the arm and shoulder of the individual, a connector that is operative to join the proximal pillow to the distal pillow, and a retaining strap that is selectively operative to retain the proximal pillow and the distal pillow in place relative to the shoulder of the individual. Under this basic construction, the proximal pillow can be disposed to receive the shoulder and a portion of the upper torso of the individual, the distal pillow can be disposed to receive the arm and, additionally or alternatively, the shoulder of the individual, and the shoulder support structure can be stably retained relative to the shoulder of the individual to provide support, stabilization, and decompression to the shoulder.

As disclosed herein, the proximal and distal pillows can each have an arcuate reception area. For instance, the proximal and distal pillows can have a U-shaped portion with a frontal leg portion, a central portion, and a rear leg portion. The leg portions have proximal ends coupled to the central portion and distal ends spaced from the central portion. These central and frontal and rear leg portions could be disposed in a U-shape, a C-shape, a J-shape or cane shape, as portions of a circular shape, or in any other manner, each such manner should be considered to be within the scope of the invention except as expressly excluded by the claims.

Moreover, a connector, such as a selectively connected strap with a first portion fixed to the frontal leg portion of the distal pillow and a second portion fixed to the rear leg portion of the distal pillow, sections of hook and loop material, a fixed connection such as a continuous portion of the pillow, or any other fixed or selective connection, can be operative to form the distal pillow into a closed loop. The connector can be adjustable so that the closed loop formed by the distal pillow can be adjusted in size, including to accommodate the size, shape, and support preferences of the individual.

Pursuant to embodiments of the invention, the connector operative to join the proximal pillow to the distal pillow is adjustable in length to permit an adjustment of a maximum separation between the proximal and distal pillows permitted by the connector. In certain practices, the connector operative to join the proximal pillow to the distal pillow has a first portion connected to the lower portion of the proximal pillow and a second portion coupled to the lower portion of the distal pillow whereby the connector comprises a lower connector. An upper connector can additionally be included to couple the upper portions of the proximal and distal pillows. The lower and, additionally or alternatively, the upper connector can be adjustable in length to permit an adjustment of a maximum separation between the lower portions of the proximal and distal pillows permitted by the lower and upper connectors to further adapt the support characteristics provided by the shoulder support structure to suit the needs and preferences of the individual.

Where the proximal pillow has a central portion, a frontal leg portion, and a rear leg portion and where the frontal and rear leg portions have proximal ends coupled to the central portion and distal ends spaced from the central portion, the lower connector can comprise a first lower connecting strap with a first end connected to the frontal leg portion of the proximal pillow and a second end retained relative to the distal pillow. Further, a second lower connecting strap can be included with a first end coupled to the rear leg portion of the proximal pillow and a second end connected to the distal pillow.

Where the distal pillow has a central portion, a frontal leg portion, and a rear leg portion and where the frontal and rear leg portions have proximal ends coupled to the central portion and distal ends spaced from the central portion, the second end of the first lower connecting strap can be retained relative to the frontal leg portion of the distal pillow and the second end of the second lower connecting strap can be retained relative to the rear leg portion of the distal pillow.

The first and second lower connecting straps are individually adjustable in length whereby the maximum separation of the frontal and rear leg portions of the proximal and distal pillows can be selectively and individually adjusted. Where a connector is provided to form the distal pillow into a closed loop, the second ends of the first and second lower connecting straps can be retained by that connector, or the second ends could be retained by directly and respectively coupling to the frontal and rear leg portions of the distal pillow.

In certain practices of the invention, the retaining strap has a first end coupled to the proximal pillow, a body portion for encircling the individual, and a second end coupled to the proximal pillow. For instance, the first end of the retaining strap can be coupled to a frontal portion of the upper portion of the proximal pillow while the second end of the retaining strap is coupled to a rear portion of the upper portion of the proximal pillow. With that, the retaining strap comprises an upper retaining strap. A lower retaining strap can additionally be included with a first end coupled to a frontal portion of the lower portion of the proximal pillow and a second end coupled to a rear portion of the lower portion of the proximal pillow. For example, where the proximal pillow has a central portion, a frontal leg portion, and a rear leg portion, the first end of the lower retaining strap can be coupled to the frontal leg portion of the proximal pillow and the second end of the lower retaining strap can be coupled to the rear leg portion of the proximal pillow.

Pursuant to the invention, either or both of the proximal and distal pillows can be selectively adjustable in effective size and firmness. By way of example, the pillows could be partially or entirely air-filled such that inflation or deflation can adjust the effective size and firmness of the pillows to accommodate varied individual sizes and shapes and different support needs and preferences. Other filling and padding materials could be additionally or alternatively included.

Bilateral embodiments of the shoulder support structure are taught herein wherein the proximal and distal pillows cooperate to form a left shoulder support and wherein the shoulder support structure further comprises a right shoulder support. The right shoulder support can also have a proximal pillow with an upper portion, a lower portion, and a reception area for receiving the shoulder and upper torso of the individual, a distal pillow with an upper portion, a lower portion, and a reception area for receiving the arm and shoulder of the individual, and a connector to join the proximal pillow to the distal pillow. In such embodiments, the retaining strap can have a first end coupled to the left shoulder support and a second end coupled to the right shoulder support. Still further, the retaining strap can take the form of a front retaining strap with a first end coupled to a frontal portion of the left shoulder support and a second end coupled to a frontal portion of the right shoulder support, and a back strap can have a first end coupled to a rear portion of the left shoulder support and a second end coupled to a rear portion of the right shoulder support. With that, the bilateral shoulder support structure can provide simultaneous support, stabilization, and decompression to the left and right shoulders of the individual.

One will appreciate that the foregoing discussion broadly outlines the more important goals and certain features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF THE DRAWINGS

The present invention will be described and explained with additional specificity and detail through reference to the accompanying drawings wherein.

DETAILED DESCRIPTION OF PREFERRED EMBODIMENTS

Figure 1:
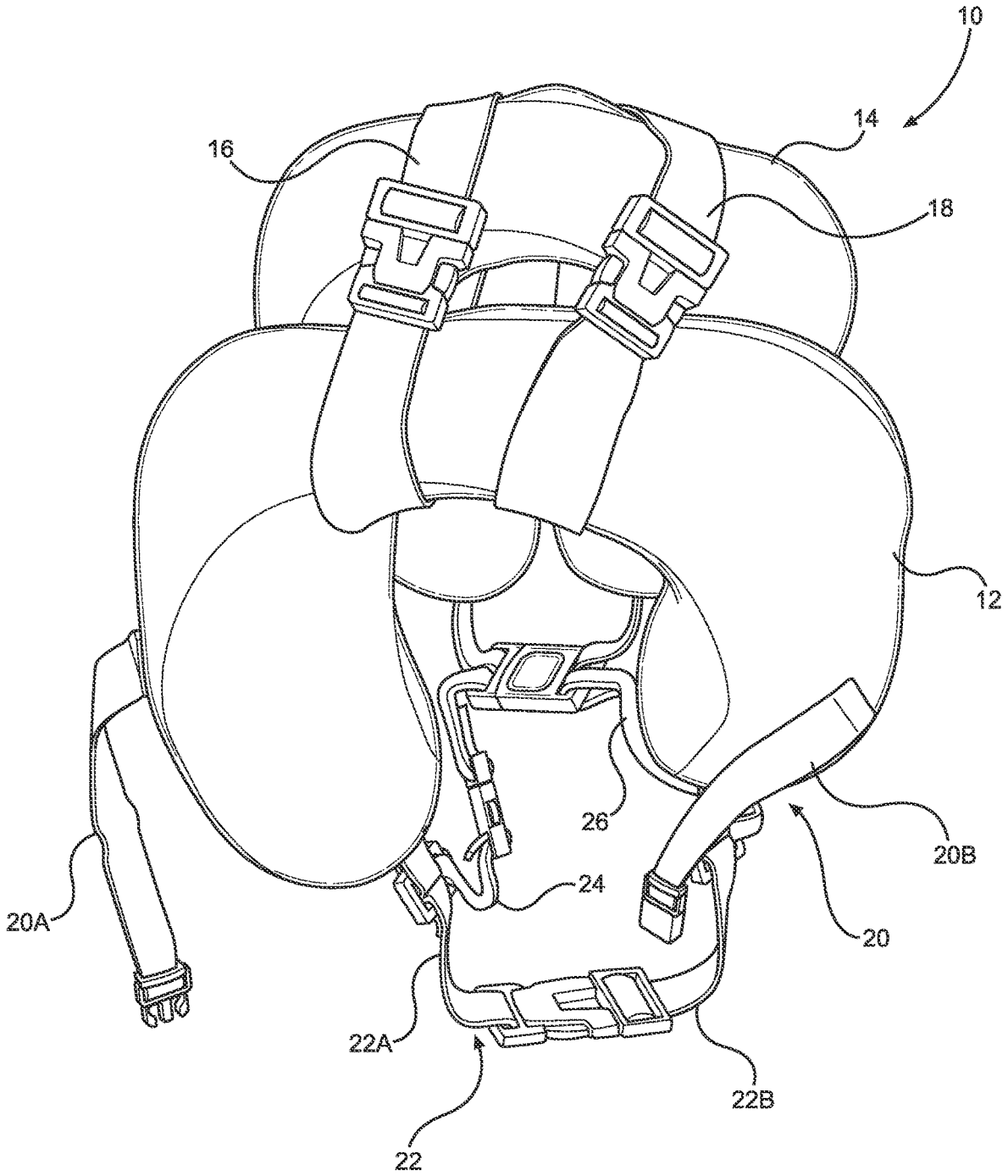
FIG. 1 is an inner perspective view of a shoulder support structure for lateral decubitus positioning according to the present invention.
Figure 2:
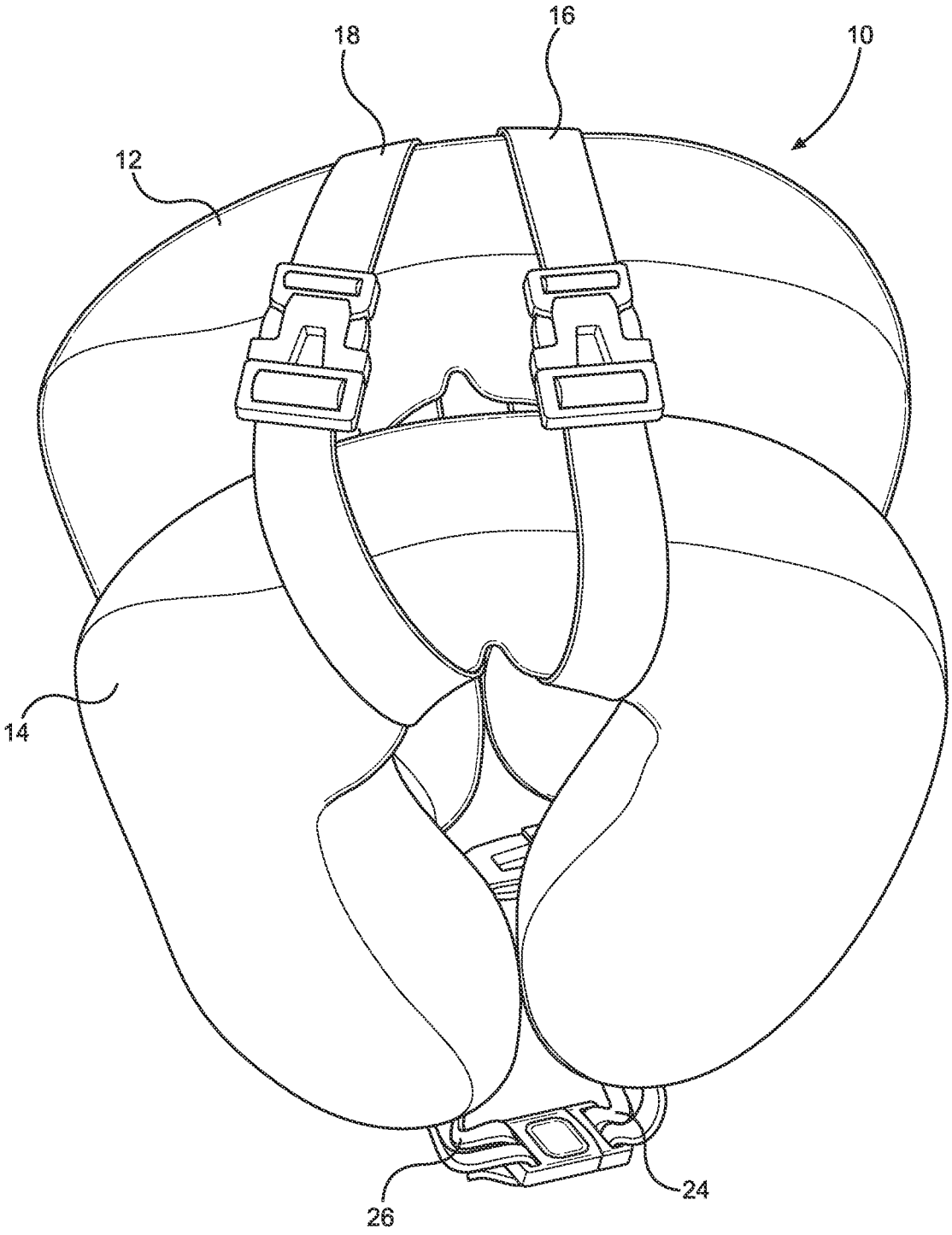
FIG. 2 is an outer perspective view of the shoulder support structure.
Figure 3:
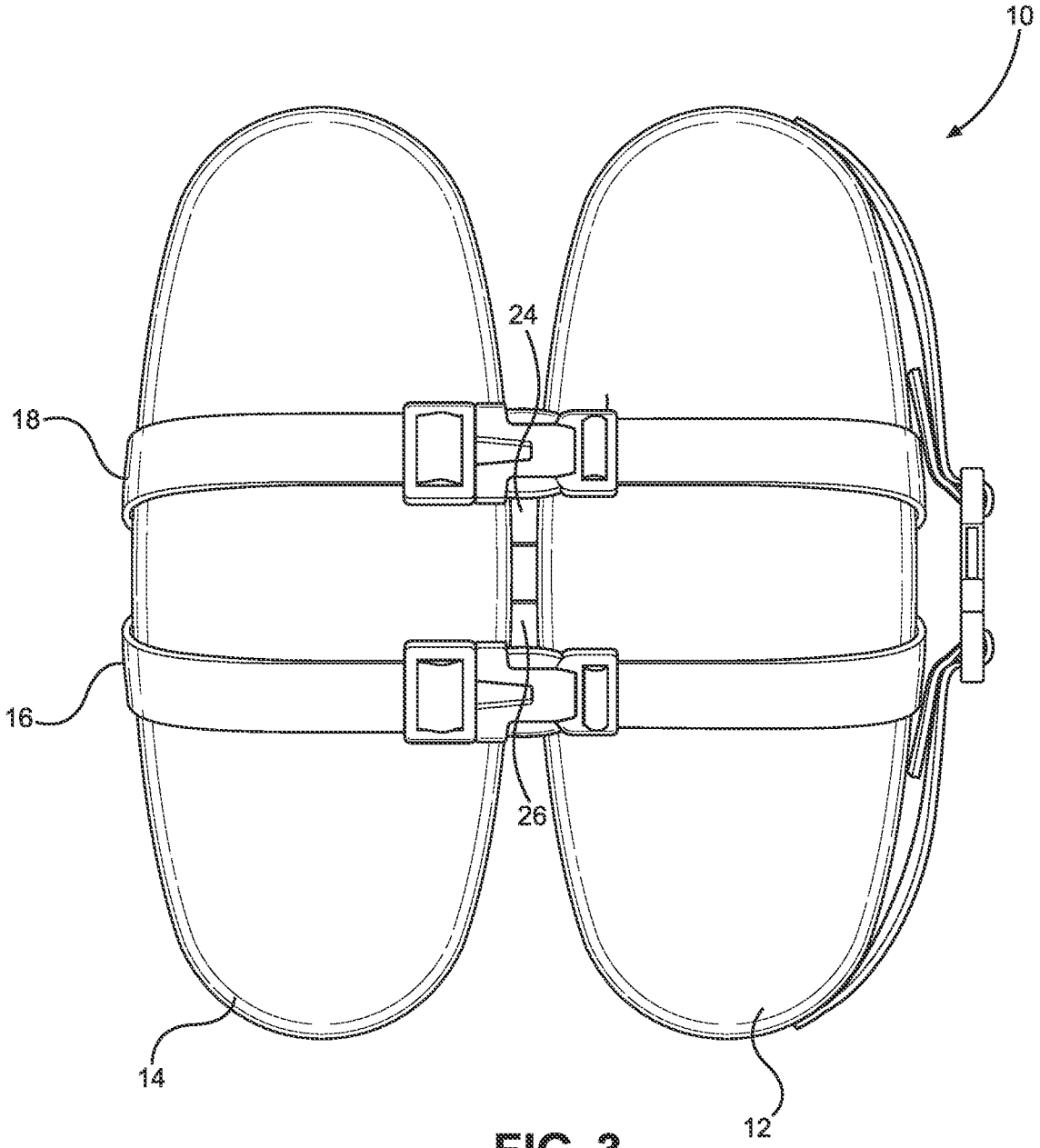
FIG. 3 is a top plan view of the shoulder support structure.
Figure 4:
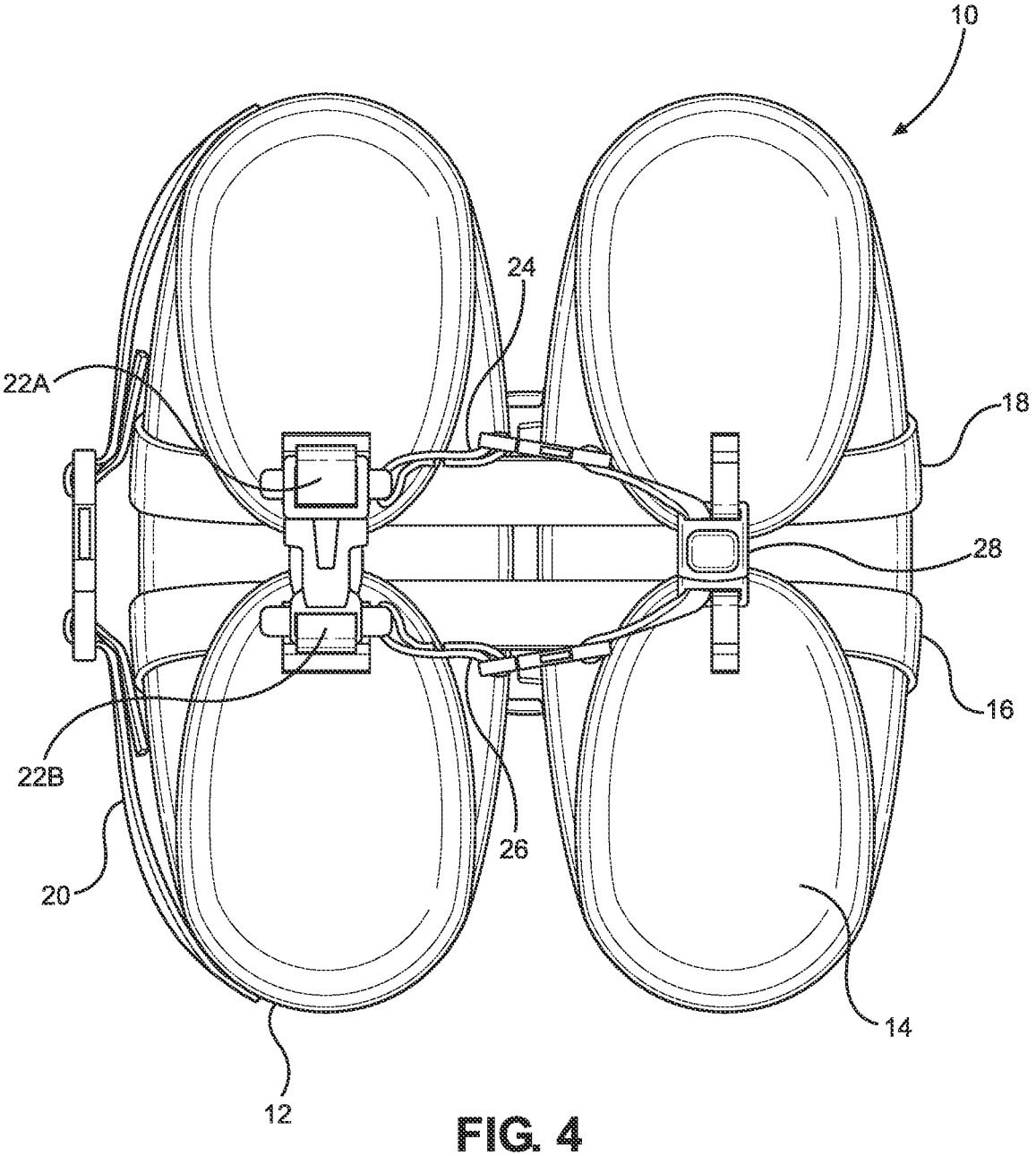
FIG. 4 is a bottom plan view of the shoulder support structure.

The shoulder support structure disclosed herein is subject to a wide variety of embodiments, each within the scope of the invention. To ensure that one skilled in the art will fully understand and, in appropriate cases, be able to practice the present invention, certain preferred embodiments and aspects of the shoulder support structure are described below and shown in the accompanying drawing figures. It will be understood, however, that the disclosed embodiments of the shoulder support structure are mere examples thereof and should not be considered to be limiting in any manner.

Looking more particularly to the drawings, a shoulder support structure according to the present invention is indicated generally at 10 in FIGS. 1 through 4. There, the shoulder support structure 10 can be seen to be founded on a proximal pillow 12, which may alternatively be referred as a torso pillow 12, in combination with a distal pillow 14, which may alternatively be referred to as an arm pillow 14. In the illustrated embodiment, each of the torso and arm pillows 12 and 14 has an arcuate reception area. The arcuate reception area of the arm pillow 14 is adapted for receiving the arm and potentially a portion of the shoulder of a user while the arcuate reception area of the torso pillow 12 is adapted for receiving the user's shoulder and an upper portion of the torso. In the depicted example, the torso and arm pillows 12 and 14 are both generally U-shaped, but it is within the scope of the invention for either or both pillows 12 and 14 to have a different shape, such as a cane shape, a C-shape, an annular shape potentially with an open or separable portion, or any other shape with a reception area for the arm or shoulder of the user. According to embodiments of the invention, it would be possible for the distal arm pillow 14 to be formed as a ring to be received onto the arm 138. In such practices, an inner portion of the arm pillow 14 potentially could be flatter and thinner than the leg and central portions.

The proximal and distal pillows 12 and 14 can each be contoured and generally continuous in shape and structure. Alternatively, the pillows 12 and 14 can be segmented or with differing shapes and structures therealong. In either case, each of the proximal and distal pillows 12 and 14 can be considered to have a frontal leg portion, a central portion, and a rear leg portion. The leg portions have proximal ends coupled to the central portion and distal ends spaced from the central portion. Each of the frontal leg portion, the central portion, and the rear leg portion can include one or more sub-portions, and further portions could additionally be included. The central portion and the frontal and rear leg portions should be considered to exist in a U-shaped or C-shaped structure as shown, a J- or cane-shaped structure, a circular structure, or any other structure with such portions, even if additional portions are included.

With combined reference to FIGS. 1 through 4, the central portions of the proximal and distal pillows 12 and 14 can be seen to be coupled together in this example by first and second upper connecting straps 16 and 18 that are disposed in parallel. The upper connecting straps 16 and 18 can be fixed or adjustable in length, resiliently stretchable or non-stretchable. In the depicted embodiment, the upper connecting straps 16 and 18 are formed in loops that encircle the central portions of the proximal and distal pillows 12 and 14. The upper connecting straps 16 and 18 are adjustable in length whereby the maximum separation of the central portions of the proximal and distal pillows 12 and 14 can be selectively adjusted.

A first lower connecting strap 24 connects the distal end of the frontal leg portion of the proximal pillow 12 to the distal end of the frontal leg portion of the distal pillow 14, and a second lower connecting strap 26 connects the distal end of the rear leg portion of the proximal pillow 12 to the distal end of the rear leg portion of the distal pillow 14. The lower connecting straps 24 and 26 can be adjustable or fixed in length, elastic or inelastic. In the depicted embodiment, the lower connecting straps 24 and 26 are individually adjustable in length whereby the maximum separation of the distal ends of the frontal and rear leg portions of the proximal and distal pillows 12 and 14 can be selectively and individually adjusted.

Further still, a connector 28 selectively connects the distal ends of the frontal and rear leg portions of the distal pillow 14 whereby the distal pillow 14 can selectively be formed into a closed loop. In the depicted embodiment, the connector 28 comprises a latching or sliding buckle connector 28 with first and second abbreviated strap portions coupled to the distal ends of the frontal and rear leg portions of the distal pillow 14. It will be recognized that numerous other types of connectors 28, including one or more strap portions or portions of the frontal and rear leg portions with hook and loop material or any other fixed or adjustable connector 28, would be possible and within the scope of the invention. Either or both strap portions can be adjustable in length whereby the maximum separation of the distal ends of the frontal and rear leg portions of the distal pillow 14 can be adjusted, including to adjust the opening defined within the distal pillow 14 to accommodate the size or shape of the arm 138 of the individual 100 or to achieve particular support characteristics.

In this non-limiting embodiment, the ends of the lower connecting straps 24 and 26 are coupled to the connector 28 spanning between the distal ends of the frontal and rear leg portions of the distal pillow 14. However, it is within the scope of the invention for the ends of lower connecting straps 24 and 26 to be connected directly to the distal ends of the frontal and rear leg portions of the distal pillow 14. Each configuration should be considered to establish a connection to the leg portions of the distal pillow 14.

An upper retaining strap 20 has a first end fixed to extend from the proximal pillow 12 adjacent to the proximal end of the frontal leg portion and a second end fixed to extend from the proximal pillow 12 adjacent to the proximal end of the rear leg portion. In the present embodiment, the upper retaining strap 20 is formed by first and second strap sections 20A and 20B. An adjustable buckle connector has a first buckle member disposed at the distal end of the first strap section 20A and a second buckle member disposed at the distal end of the second strap section 20B. The buckle enables a selective coupling of the first and second strap sections 20A and 20B to form the completed upper retaining strap 20 and an adjustment of the effective length of the upper retaining strap 20.

In a similar manner, a lower retaining strap 22 has a first end fixed to extend from the proximal pillow 12 adjacent to the distal end of the frontal leg portion and a second end fixed to extend from the proximal pillow 12 adjacent to the distal end of the rear leg portion. The lower retaining strap 22 in this example is formed by first and second strap sections 22A and 22B. An adjustable buckle connector has a first buckle member disposed at the distal end of the first strap section 22A and a second buckle member disposed at the distal end of the second strap section 22B. The buckle again enables a selective coupling of the first and second strap sections 22A and 22B to form the completed lower retaining strap 22 and an adjustment of the effective length of the lower retaining strap 22.

The constructions of the proximal and distal pillows 12 and 14 can vary within the scope of the invention. In certain embodiments, for example, the proximal and distal pillows 12 and 14 are formed with inflatable inner bladders that can be enveloped in a shell or casing of fabric and, additionally or alternatively, padding. With that, the pillows 12 and 14 or perhaps individual portions thereof can be selectively adjusted in effective size and firmness to accommodate, among other things, varied body sizes and shapes and different user needs and preferences. In other embodiments, the proximal and distal pillows 12 and 14 can be formed with outer shells of flexible material, such as fabric, plastic or rubber sheeting, or any other material or combination thereof. Filler material may be disposed within the proximal and distal pillows 12 and 14 alone or in combination with one or more inflatable bladders. The filler could comprise any suitable material that is preferably resiliently compressible, such as polyester or other batting, memory foam, a gel or liquid, air, or any combination thereof.

The pillows 12 and 14 can have one unitary inner compartment so that the entire pillow 12 or 14 can be selectively adjusted in firmness and dimension, or the pillows 12 and 14 can have multiple, individually adjustable compartments, such as first and second leg compartments within the frontal and rear leg portions respectively and a central compartment. Where separate compartments are provided within the pillows 12 and 14, the compartments can be individually expanded and contracted, such as by inflation and deflation or in any other way, to accommodate varied user sizes, preferences, and other desired size, firmness, and further characteristics.

Figure 5:
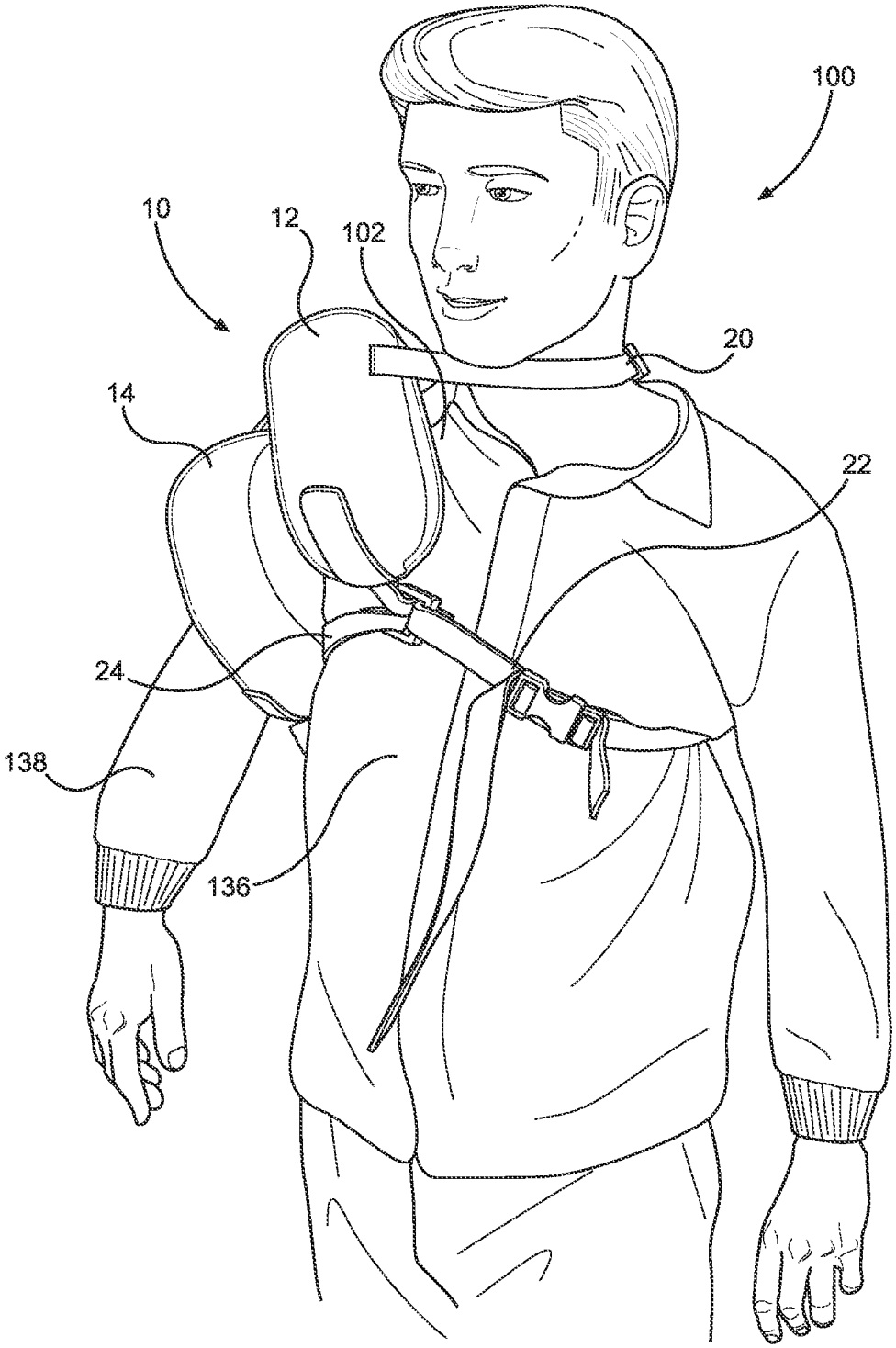
FIG. 5 is a perspective view of a shoulder support structure for lateral decubitus positioning as taught herein in position worn by a user.
Figure 6:
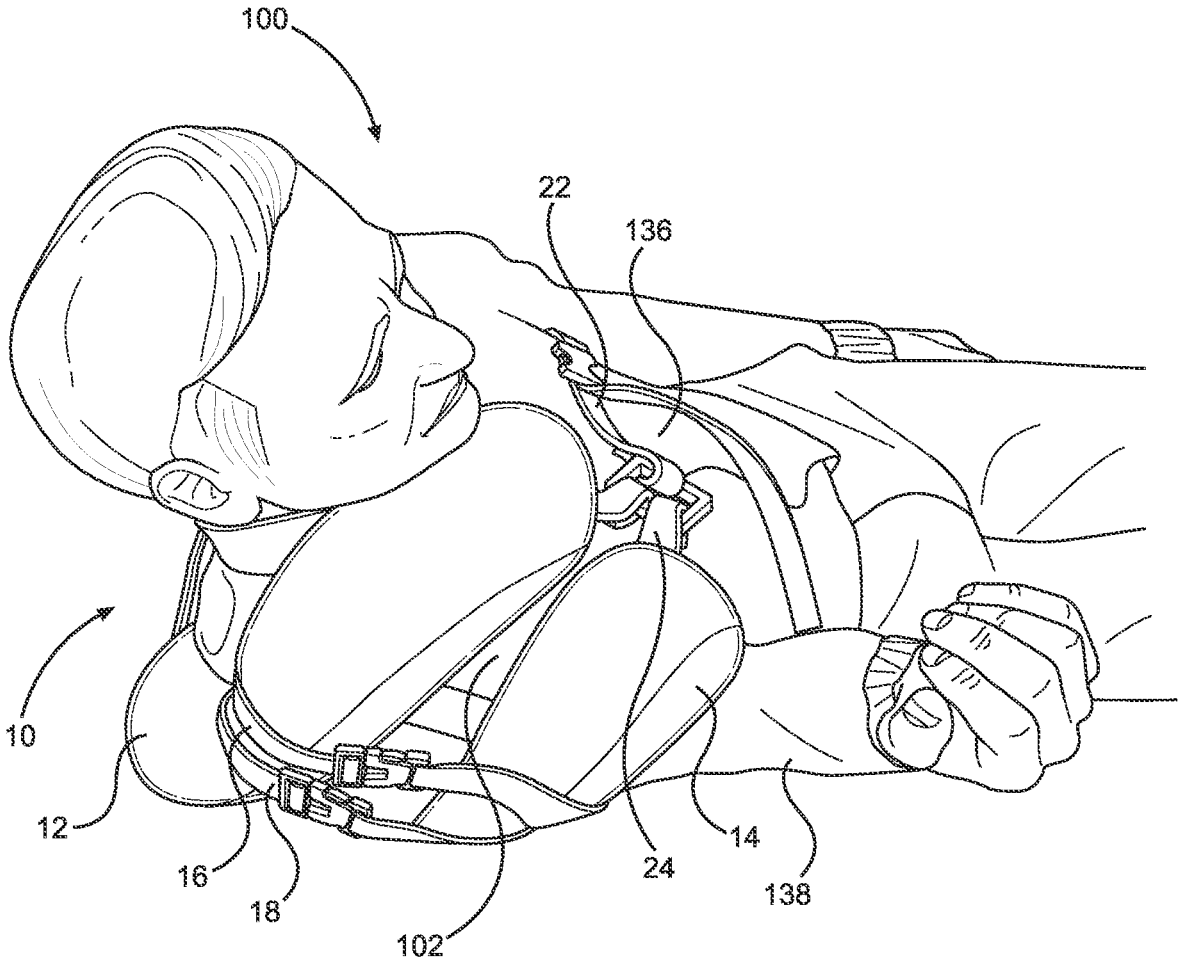
FIG. 6 is a forward perspective view of the shoulder support structure worn by a user in the lateral decubitus position.
Figure 7:
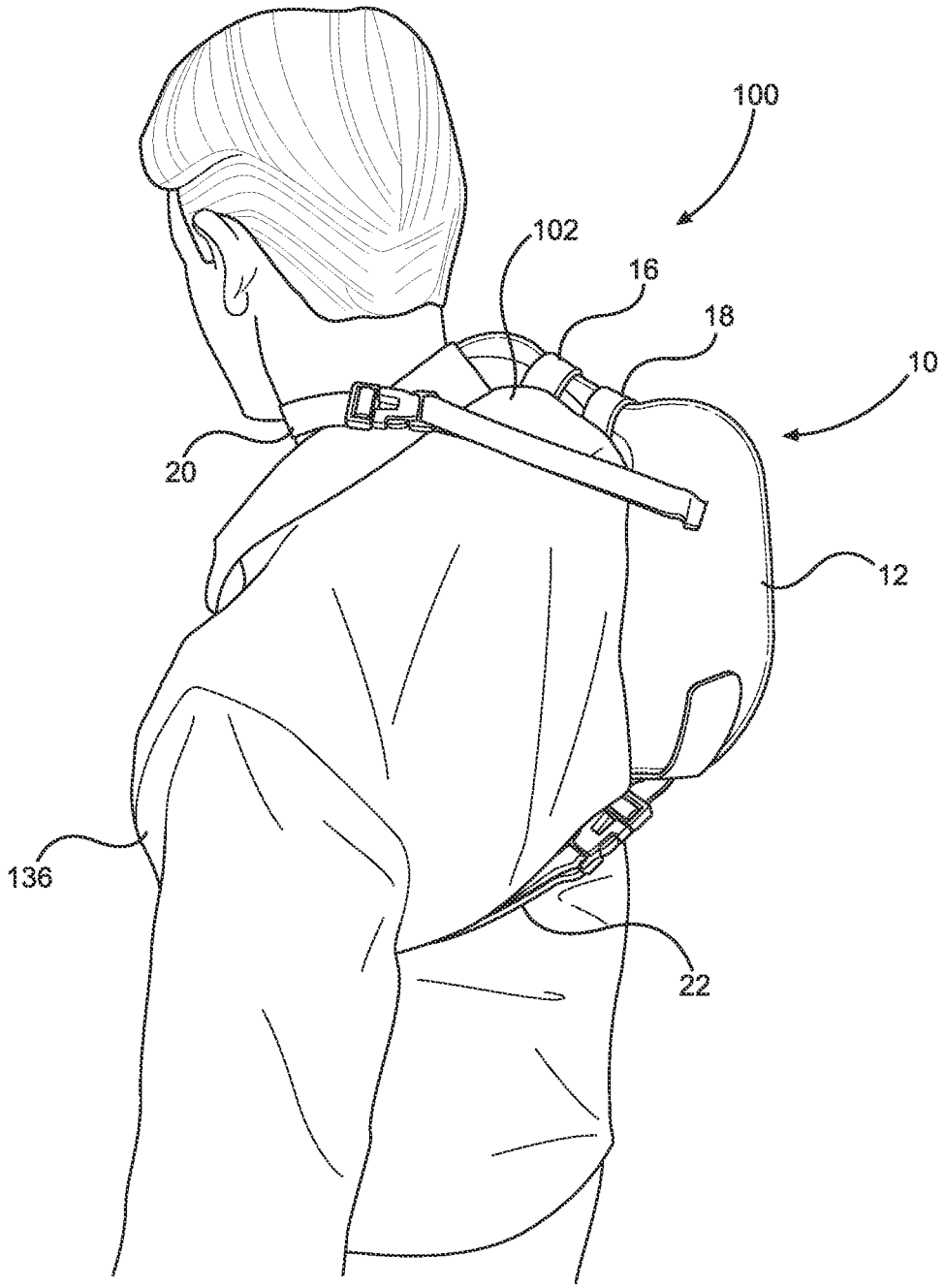
FIG. 7 is a rearward perspective view of the shoulder support structure worn by a user.
Figure 8:
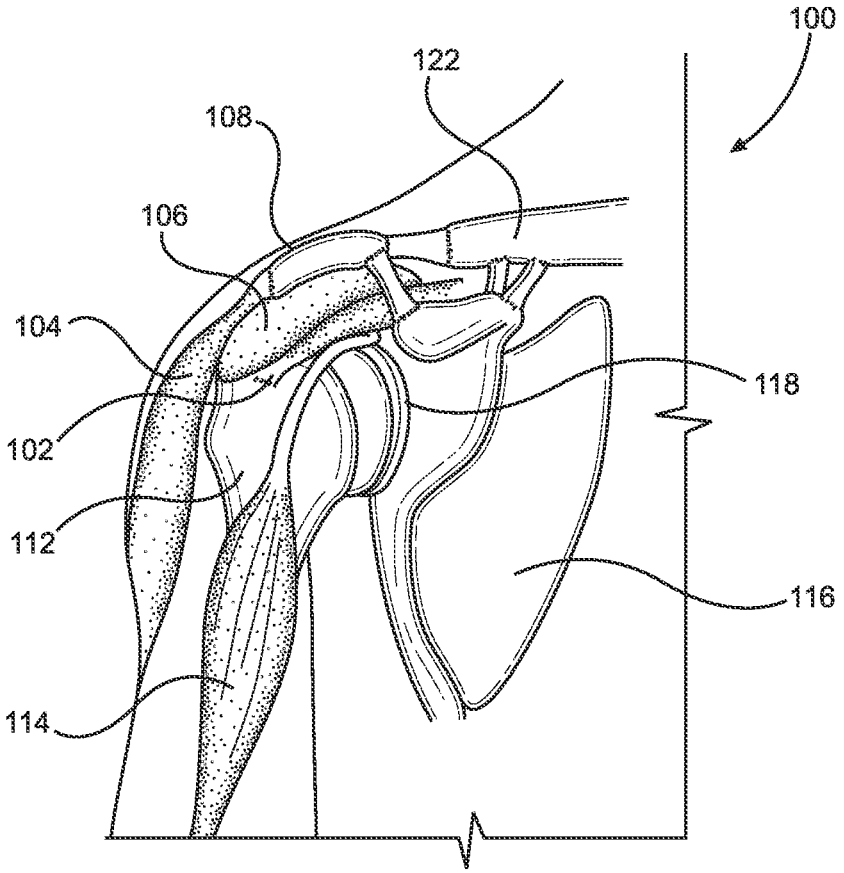
FIG. 8 is an anterior view of the structure of a human shoulder.
Figure 9:
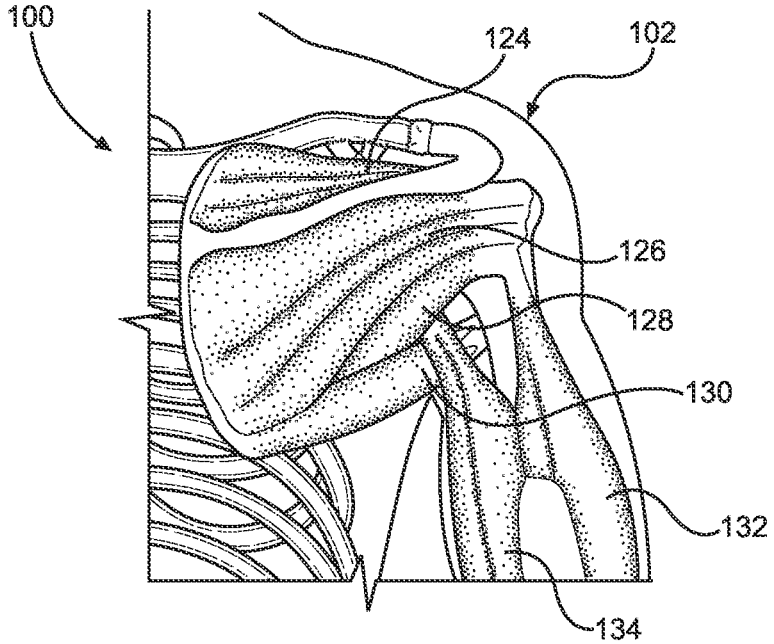
FIG. 9 is a posterior view of the structure of the human shoulder.

So constructed, the shoulder support structure 10 can be applied to the left or right shoulders 102 of an individual 100 as is shown in FIGS. 5 through 7 to provide adjustable, comfortable, and stable support to the shoulder 102 during rest or sleep in the side position. As illustrated, the shoulder support structure 10 can be disposed with the proximal pillow 12 receiving the trapezius portion of the shoulder 102 and a portion of the upper torso into the arcuate inlet defined by the central and frontal and rear leg portions of the pillow 12 with the frontal leg of the pillow 12 located over the chest of the individual 100 and with the rear leg of the pillow 12 located over the person's scapular. As shown, the upper retaining strap 20 can be strapped around the neck of the individual 100, whether by passing the completed strap 20 over the head of the individual 100 or by connecting the first and second strap sections 20A and 20B to cause the completed strap 20 to receive the head and neck of the individual 100 within the loop defined by the strap 20 and the proximal pillow 12. The upper retaining strap 20 thus may alternatively be referred to as a neck strap 20. Further, the lower retaining strap 22 can be strapped around the torso 136 of the individual 100, such as by passing the first and second strap sections 22A and 22B around the torso 136 and connecting the sections 22A and 22B. When so applied, the lower retaining strap 22 may alternatively be referred to as a torso strap 22. Each strap 20 and 22 can be adjusted in position and length to retain the proximal pillow 12 in a desired, stable position in relation to the shoulder 102 of the individual 100.

With the proximal pillow 12 so retained relative to the torso and shoulder 102 of the individual by the upper and lower retaining straps 20 and 22, the distal pillow 14 and the shoulder support structure 10 in general are likewise stably retained by operation of the upper and lower connecting straps 16, 18, 24, and 26. Pursuant to practices of the invention, the distal pillow 14 may be caused by operation of the body of the pillow 14 and the connection 28 to be retained encircling the arm 138 below the shoulder head 108 and over the shaft of the humeral bone 112 and shoulder muscles 124, 126, 128, and 130. Advantageously, by operation of the neck and torso straps 20 and 22, the shoulder support structure 10 resists inadvertent displacement, even while the wearer sleeps, thereby maintaining support and comfort and permitting safe, restful sleep.

The proximal and distal pillows 12 and 14 and the straps 16, 18, 20, 22, 24, and 26 adjustably connecting the pillows 12 and 14 to one another and the support structure 10 to the shoulder 102, torso 136, and arm 138 thus work in synergy to stabilize, support, and decompress the shoulder joint and the shoulder 102 in general. The proximal torso pillow 12 is retained firmly in relation to the torso 136 in a substantially fixed manner by the neck and torso straps 20 and 22 while the distal arm pillow 14 is maintained partially or completely encircling the arm 138 at a desired spacing relative to the shoulder head 108 by operation of the upper and lower connecting straps 16, 18, 24, and 26. The adjustable elastic or inelastic straps 16, 18, 24, and 26 are operable to regulate the proximity of the distal arm pillow 14 to the proximal pillow 12 and thus to the shoulder head 108 and the glenohumeral shoulder joint.

The ability to adjust the distance variation between the proximal and distal pillows 12 and 14 enables the shoulder support structure 10 to be adjusted to suit any body shape or size to enhance shoulder decompression and to promote comfort during side sleeping. Moreover, where one or more portions or the entireties of the proximal and distal pillows 12 and 14 are adjustable in size and firmness, such as by inflation or deflation or other size adjustment, different body sizes and shapes, preferences, and needs can be further accommodated to promote stable and comfortable support of the shoulder 102 during side sleeping.

The distal arm pillow 14 distributes the body weight of the individual 100 that would otherwise be applied to the shoulder 102 and thus decompresses the shoulder joint. Adjusting the size of each pillow 12 and 14 and the relative sizes of the pillows 12 and 14 and the distance between them by operation of the straps 16, 18, 24, and 26 creates what effectively comprises a vacuum for a deranged shoulder 102 thereby achieving what is among the primary objectives of the present invention: shoulder decompression for an individual in the lateral decubitus position. Pain and discomfort are thus diminished, and the ability to obtain quality sleep is improved. Moreover, the progression of shoulder arthritis can be prevented or at least minimized. Treatment of shoulder derangement is facilitated, and shoulder function can be restored while debilitating conditions can be prevented. By enabling decompression during side resting and sleep, the shoulder support structure 10 permits improved circulation of the affected shoulder structures and thus improved regeneration of the damaged shoulder tissues. All of these benefits can lead not only to a healthier shoulder 102 but also to an improved quality of life.

Figure 10:
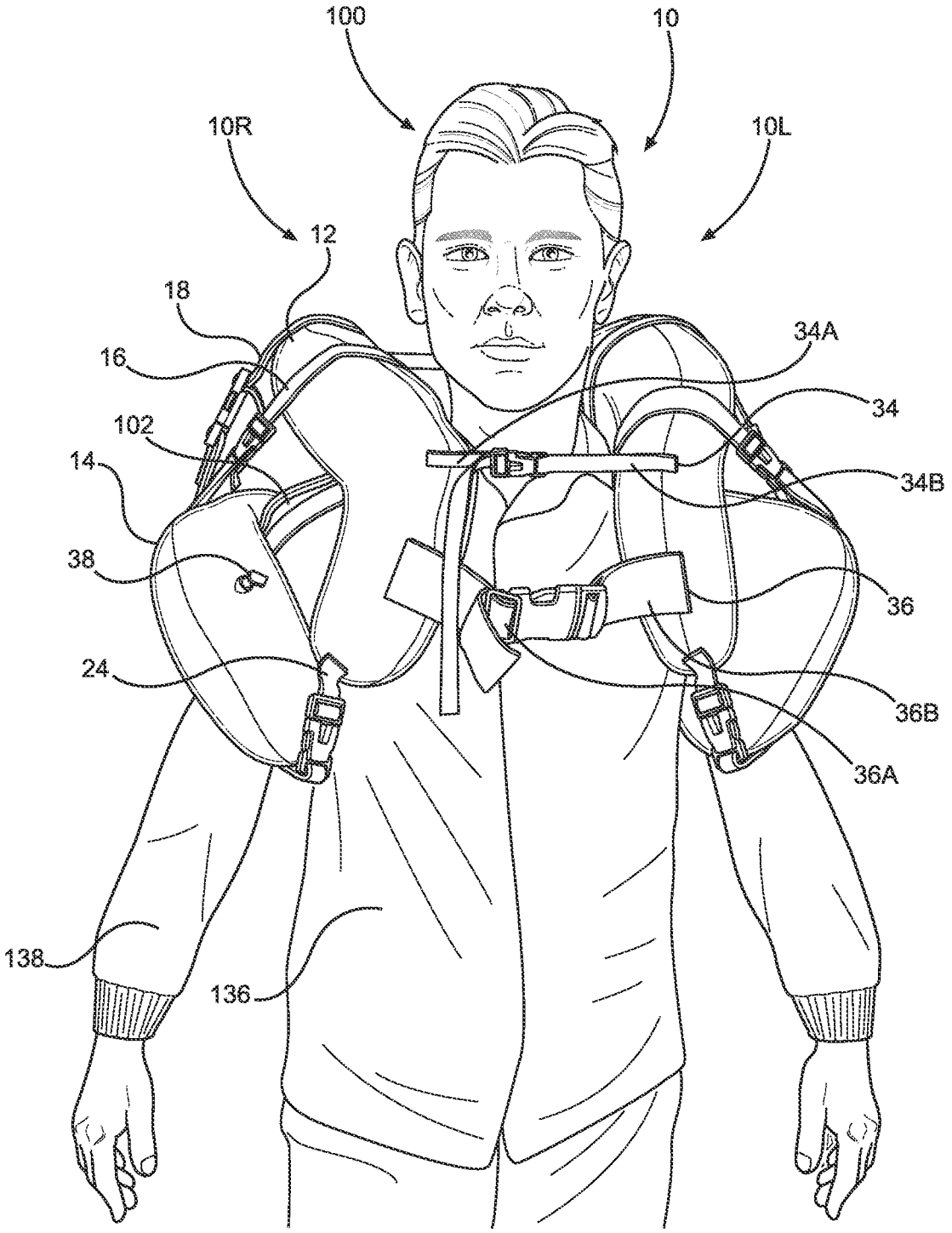
FIG. 10 is a view in front elevation of an alternative, bilateral embodiment of the shoulder support structure.
Figure 11:
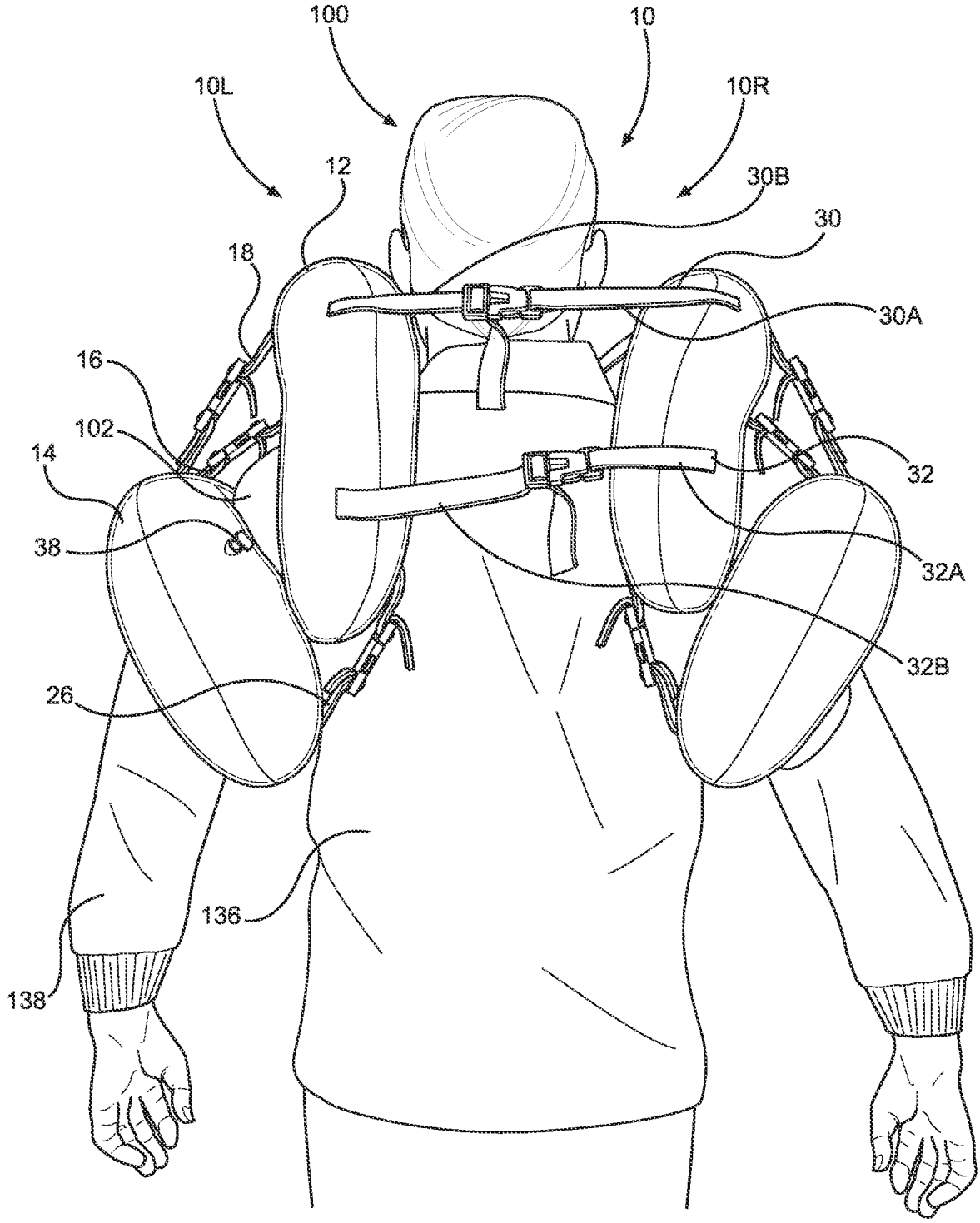
FIG. 11 is a view in rear elevation of the bilateral shoulder support structure.

Bilateral embodiments of the shoulder support structure 10 are possible and within the scope of the invention. As shown in FIGS. 10 and 11, such bilateral shoulder support structures 10 could provide a proximal pillow 12 and a distal pillow 14 for each of the left and right shoulders 102 thereby to provide a left shoulder support structure 10L and a right shoulder support structure 10R. Each of the proximal and distal pillows 12 and 14 can again have an arcuate reception area with the arcuate reception area of the distal pillow 14 adapted for receiving the arm and potentially a portion of the shoulder 102 of a user and the arcuate reception area of the torso pillow 12 adapted for receiving the shoulder 102 and torso 136. In the embodiment illustrated, the arm and torso pillows 14 and 12 are again both generally U-shaped, but it is within the scope of the invention for either or both pillows 12 and 14 to have a different shape, such as a cane shape, a C-shape, an annular shape potentially with an open or separable portion, or any other shape with a reception area for the arm 138 or shoulder 102 of the individual 100. It would again be possible for the distal arm pillow 14 to be formed as a ring to be received onto the left or right arm 138.

Each of the proximal and distal pillows 12 and 14 can be considered to have a frontal leg portion, a central portion, and a rear leg portion. The leg portions have proximal ends coupled to the central portion and distal ends spaced from the central portion. Again, each of the frontal leg portion, the central portion, and the rear leg portion can include one or more sub-portions. Further portions could additionally be included.

The central portions of the proximal and distal pillows 12 and 14 of each of the left and right shoulder support structures 10L and 10R are again coupled by first and second upper connecting straps 16 and 18 disposed as loops encircling the central portions of the pillows 12 and 14 in parallel. The upper connecting straps 16 and 18 can be elastic or inelastic and fixed or adjustable in length. For each structure 10L and 10R, a first lower connecting strap 24 connects the distal ends of the frontal leg portions of the proximal pillows 12 to the distal ends of the frontal leg portions of the distal pillows 14, and a second lower connecting strap 26 connects the distal ends of the rear leg portions of the proximal pillows 12 to the distal ends of the rear leg portions of the distal pillows 14. The lower connecting straps 24 and 26 are individually adjustable in length whereby the maximum separation of the distal ends of the frontal and rear leg portions of the proximal and distal pillows 12 and 14 can be selectively and individually adjusted.

A detachable connector 28 selectively connects the distal ends of the frontal and rear leg portions of the distal pillows 14 so that the distal pillows 14 can selectively be formed into closed loops to encircle a user's arms 138. Each connector 28 can, for example, comprise a latching or sliding buckle connector 28 with first and second abbreviated strap portions coupled to the distal ends of the frontal and rear leg portions of the distal pillow 14. Again, hook and loop sections or any other detachable connector 28 would alternatively be possible. The connectors 28 can be adjustable in effective length whereby the maximum separation of the distal ends of the frontal and rear leg portions of the distal pillows 14 can be adjusted to accommodate the size or shape of the arms 138 of the individual 100 or to achieve particular support characteristics.

An upper front strap 34 has a first end fixed to extend from the proximal pillow 12 of the left shoulder support structure 10L adjacent to the proximal end of the frontal leg portion thereof and a second end fixed to extend from the proximal pillow 12 of the right shoulder support structure 10R adjacent to the proximal end of the frontal leg portion thereof, and a lower front strap 36 has a first end fixed to extend from the proximal pillow 12 of the left shoulder support structure 10L adjacent to the distal end of the frontal leg portion thereof and a second end fixed to extend from the proximal pillow 12 of the right shoulder support structure 10R adjacent to the distal end of the frontal leg portion thereof. The upper front strap 34 is formed by first and second strap sections 34A and 34B. An adjustable buckle connector has a first buckle member disposed at the distal end of the first strap section 34A and a second buckle member disposed at the distal end of the second strap section 34B. The buckle connector enables a selective coupling of the first and second strap sections 34A and 34B to form the completed upper front strap 34 and an adjustment of the effective length of the upper front strap 34. The lower front strap 36 is similarly configured with first and second strap sections 36A and 36B and an adjustable buckle connector to enable a selective coupling of the strap sections 36A and 36B to form the completed lower front strap 36 and an adjustment of the effective length of the lower front strap 36.

Upper and lower back straps 30 and 32 are correspondingly disposed to the rear of the left and right shoulder support structures 10L and 10R. The upper back strap 30 has a first end fixed to extend from the proximal pillow 12 of the left shoulder support structure 10L adjacent to the proximal end of the rear leg portion thereof and a second end fixed to extend from the proximal pillow 12 of the right shoulder support structure 10R adjacent to the proximal end of the rear leg portion thereof, and a lower rear strap 32 has a first end fixed to extend from the proximal pillow 12 of the left shoulder support structure 10L adjacent to the distal end of the rear leg portion thereof and a second end fixed to extend from the proximal pillow 12 of the right shoulder support structure 10R adjacent to the distal end of the rear leg portion thereof. The upper rear strap 30 is formed by first and second strap sections 30A and 30B. An adjustable buckle connector has a first buckle member disposed at the distal end of the first strap section 30A and a second buckle member disposed at the distal end of the second strap section 30B. The buckle connector enables a selective coupling of the first and second strap sections 30A and 30B to form the completed upper back strap 30 and an adjustment of the effective length of the upper back strap 30. The lower rear strap 32 is similarly configured with first and second strap sections 32A and 32B and an adjustable buckle connector to enable a selective coupling of the strap sections 32A and 32B to form the completed lower rear strap 32 and an adjustment of the effective length of the lower rear strap 32.

The constructions of the proximal and distal pillows 12 and 14 of the left and right shoulder support structures 10L and 10R can vary as shown and described in relation to the single-shoulder embodiment of the shoulder support structure 10. The proximal and distal pillows 12 and 14 again can be formed with inflatable inner bladders enveloped in a shell or casing of fabric or other material. The pillows 12 and 14 could additionally or alternatively be filled with padding, such as polyester or other batting, memory foam, a gel or liquid, or any combination thereof. The pillows 12 and 14 or perhaps individual portions thereof potentially can be selectively adjusted in effective size and firmness, such as by inflation or deflation through inflation apertures 38, to accommodate, among other things, varied body sizes and shapes and different user needs and preferences. Each pillow 12 and 14 can have one unitary inner compartment so that the entire pillow 12 or 14 can be selectively adjusted in firmness and dimension, or the pillows 12 and 14 can have multiple, individually adjustable compartments that can be individually expanded and contracted, such as by inflation and deflation or in any other way, to accommodate varied user sizes, preferences, and other desired size, firmness, and further characteristics.

Under such constructions, the bilateral shoulder support structure 10 can be applied to both the left and right shoulders 102 of an individual 100 to provide adjustable, comfortable, and stable support to the shoulders 102 during rest or sleep in either the left or right lateral decubitus positions. Each proximal pillow 12 can be disposed to receive the trapezius portion of the shoulder 102 into the arcuate inlet defined by the central and frontal and rear leg portions of the pillow 12. The upper and lower back and front straps 30, 32, 34, and 36 can be connected and adjusted as necessary to join the left and right shoulder support structures 10L and 10R and thus to retain the shoulder support structure 10 and each of the left and right shoulder support structures 10L and 10R stably in relation to the left and right shoulders 102 of the individual 100. With the proximal pillows 12 retained in place by the upper and lower back and front straps 30, 32, 34, and 36, the distal pillows 14 are likewise stably yet adjustably retained by operation of the upper and lower connecting straps 16, 18, 24, and 26 as previously described.

The bilateral shoulder support structure 10 resists inadvertent displacement, even while the wearer sleeps, thereby maintaining support and comfort and permitting safe, restful sleep in either side position. The proximal and distal pillows 12 and 14 of each of the left and right shoulder support structures 10L and 10R work in synergy to stabilize, support, and decompress each shoulder joint and each shoulder 102 generally. The adjustable elastic or inelastic straps 16, 18, 24, and 26 regulate the proximity of the distal arm pillows 14 to the respective proximal pillows 12 and thus to the shoulder head 108 and the glenohumeral shoulder joint. Where one or more portions or the entireties of the proximal and distal pillows 12 and 14 are adjustable in size and firmness, such as by inflation or deflation or other size adjustment, different body sizes and shapes, preferences, and needs can be further accommodated to promote stable and comfortable support of each shoulder 102 during side sleeping.

With certain details and embodiments of the present invention for a shoulder support structure 10 disclosed, it will be appreciated by one skilled in the art that numerous changes and additions could be made thereto without deviating from the spirit or scope of the present invention. This is particularly true when one bears in mind that the presented preferred embodiments merely exemplify the broader invention revealed herein. Accordingly, it will be clear that those with major features in mind could craft embodiments that incorporate those major features while not incorporating all of the features included in the preferred embodiments.

Therefore, the following claims shall define the scope of protection to be afforded to the invention. Those claims shall be deemed to include equivalent constructions insofar as they do not depart from the spirit and scope of the invention. It must be further noted that a plurality of the following claims may express, or be interpreted to express, certain elements as means for performing a specific function, at times without the recital of structure or material. As the law demands, any such claims shall be construed to cover not only the corresponding structure and material expressly described in this specification but also all legally-cognizable equivalents thereof.

What is claimed as deserving of Letters Patent is:

1. A shoulder support structure for stabilizing and supporting a shoulder of an individual in a lateral decubitus position, the shoulder support structure comprising:

a proximal pillow wherein the proximal pillow has an upper portion, a lower portion, and a reception area for receiving the shoulder and upper torso of the individual;

a distal pillow wherein the distal pillow has an upper portion, a lower portion, and a reception area for receiving the arm and shoulder of the individual;

a connector operative to join the proximal pillow to the distal pillow; and a retaining strap selectively operative to retain the proximal pillow and the distal pillow relative to the shoulder of the individual;

wherein each of the proximal and distal pillows has an arcuate reception area and wherein the proximal pillow has a U-shaped portion with a frontal leg portion, a central portion, and a rear leg portion wherein the frontal and rear leg portions have proximal ends coupled to the central portion and distal ends spaced from the central portion;

whereby the proximal pillow can be disposed to receive the shoulder and upper torso of the individual, the distal pillow can be disposed to receive the arm or shoulder of the individual, and the shoulder support structure with the proximal and distal pillows can be retained relative to the shoulder of the individual.

2. The shoulder support structure of claim 1, further comprising a connector operative to form the distal pillow into a closed loop.

3. The shoulder support structure of claim 2, wherein the connector comprises a selective connector for selectively forming the distal pillow into a closed loop.

4. The shoulder support structure of claim 3, wherein the connector is adjustable whereby the closed loop formed by the distal pillow can be adjusted in size.

5. The shoulder support structure of claim 1, wherein the connector operative to join the proximal pillow to the distal pillow is adjustable in length to permit an adjustment of a maximum separation between the proximal and distal pillows permitted by the connector.

6. The shoulder support structure of claim 5, wherein the connector operative to join the proximal pillow to the distal pillow has a first portion connected to the lower portion of the proximal pillow and a second portion coupled to the lower portion of the distal pillow whereby the connector operative to join the proximal pillow to the distal pillow comprises a lower connector.

7. The shoulder support structure of claim 6, further comprising an upper connector operative to couple the upper portions of the proximal and distal pillows.

8. The shoulder support structure of claim 7, wherein the lower connector is adjustable in length to permit an adjustment of a maximum separation between the lower portions of the proximal and distal pillows permitted by the lower connector.

9. The shoulder support structure of claim 8, wherein the upper connector is adjustable in length to permit an adjustment of a maximum separation between the upper portions of the proximal and distal pillows permitted by the upper connector.

10. The shoulder support structure of claim 8, wherein the proximal pillow has a central portion, a frontal leg portion, and a rear leg portion wherein the frontal and rear leg portions have proximal ends coupled to the central portion and distal ends spaced from the central portion and wherein the lower connector comprises a first lower connecting strap with a first end connected to the frontal leg portion of the proximal pillow and a second end retained relative to the distal pillow.

11. The shoulder support structure of claim 10, further comprising a second lower connecting strap with a first end coupled to the rear leg portion of the proximal pillow and a second end connected to the distal pillow.

12. The shoulder support structure of claim 11, wherein the distal pillow has a central portion, a frontal leg portion, and a rear leg portion, wherein the frontal and rear leg portions have proximal ends coupled to the central portion and distal ends spaced from the central portion, wherein the second end of the first lower connecting strap is retained relative to the frontal leg portion of the distal pillow, and wherein the second end of the second lower connecting strap is retained relative to the rear leg portion of the distal pillow.

13. The shoulder support structure of claim 12, wherein the first and second lower connecting straps are individually adjustable in length whereby the maximum separation of the frontal and rear leg portions of the proximal and distal pillows can be selectively and individually adjusted.

14. The shoulder support structure of claim 13, further comprising a connector operative to form the distal pillow into a closed loop, wherein the second ends of the first and second lower connecting straps are retained by the connector operative to form the distal pillow into a closed loop.

15. The shoulder support structure of claim 1, wherein the retaining strap has a first end coupled to the proximal pillow, a body portion for encircling the individual, and a second end coupled to the proximal pillow.

16. The shoulder support structure of claim 15, wherein the first end of the retaining strap is coupled to a frontal portion of the upper portion of the proximal pillow and wherein the second end of the retaining strap is coupled to a rear portion of the upper portion of the proximal pillow whereby the retaining strap comprises an upper retaining strap and further comprising a lower retaining strap with a first end coupled to a frontal portion of the lower portion of the proximal pillow and a second end coupled to a rear portion of the lower portion of the proximal pillow.

17. The shoulder support structure of claim 1, wherein the distal pillow is selectively adjustable in effective size and firmness.

18. The shoulder support structure of claim 1, wherein the proximal and distal pillows cooperate to form a left shoulder support and further comprising a right shoulder support comprising a proximal pillow with an upper portion, a lower portion, and a reception area for receiving the shoulder and upper torso of the individual, a distal pillow wherein the distal pillow has an upper portion, a lower portion, and a reception area for receiving the arm and shoulder of the individual, and a connector operative to join the proximal pillow to the distal pillow, and wherein the retaining strap has a first end coupled to the left shoulder support and a second end coupled to the right shoulder support.

19. The shoulder support structure of claim 18, wherein the retaining strap comprises a front retaining strap with a first end coupled to a frontal portion of the left shoulder support and a second end coupled to a frontal portion of the right shoulder support whereby the retaining strap comprises a front strap and further comprising a back strap with a first end coupled to a rear portion of the left shoulder support and a second end coupled to a rear portion of the right shoulder support.

20. A shoulder support structure for stabilizing and supporting a shoulder of an individual in a lateral decubitus position, the shoulder support structure comprising:

a proximal pillow wherein the proximal pillow has an upper portion, a lower portion, and a reception area for receiving the shoulder and upper torso of the individual;

a distal pillow wherein the distal pillow has an upper portion, a lower portion, and a reception area for receiving the arm and shoulder of the individual;

a connector operative to join the proximal pillow to the distal pillow; and a retaining strap selectively operative to retain the proximal pillow and the distal pillow relative to the shoulder of the individual;

whereby the proximal pillow can be disposed to receive the shoulder and upper torso of the individual, the distal pillow can be disposed to receive the arm or shoulder of the individual, and the shoulder support structure with the proximal and distal pillows can be retained relative to the shoulder of the individual;

wherein the retaining strap has a first end coupled to the proximal pillow, a body portion for encircling the individual, and a second end coupled to the proximal pillow;

wherein the first end of the retaining strap is coupled to a frontal portion of the upper portion of the proximal pillow and wherein the second end of the retaining strap is coupled to a rear portion of the upper portion of the proximal pillow whereby the retaining strap comprises an upper retaining strap and further comprising a lower retaining strap with a first end coupled to a frontal portion of the lower portion of the proximal pillow and a second end coupled to a rear portion of the lower portion of the proximal pillow; and wherein the proximal pillow has a central portion, a frontal leg portion, and a rear leg portion, wherein the frontal and rear leg portions have proximal ends coupled to the central portion and distal ends spaced from the central portion, wherein the first end of the lower retaining strap is coupled to the frontal leg portion of the proximal pillow, and wherein the second end of the lower retaining strap is coupled to the rear leg portion of the proximal pillow.

21. A shoulder support structure for stabilizing and supporting a shoulder of an individual in a lateral decubitus position, the shoulder support structure comprising:

a proximal pillow wherein the proximal pillow has a central portion, a frontal leg portion, and a rear leg portion wherein the frontal and rear leg portions have proximal ends coupled to the central portion and distal ends spaced from the central portion and wherein the frontal and rear leg portions and the central portion together define a reception area for receiving the shoulder and upper torso of the individual;

a distal pillow wherein the distal pillow has a central portion, a frontal leg portion, and a rear leg portion wherein the frontal and rear leg portions have proximal ends coupled to the central portion and distal ends spaced from the central portion and wherein the frontal and rear leg portions and the central portion together define a reception area for receiving the arm and shoulder of the individual;

an upper connector operative to couple the central portions of the proximal and distal pillows;

a first lower connecting strap with a first end connected to the frontal leg portion of the proximal pillow and a second end retained relative to the frontal leg portion of the distal pillow;

a second lower connecting strap with a first end connected to the rear leg portion of the proximal pillow and a second end retained relative to the rear leg portion of the distal pillow;

a retaining strap selectively operative to retain the proximal pillow and the distal pillow relative to the shoulder of the individual;

wherein the proximal and distal pillows cooperate to form a left shoulder support and further comprising a right shoulder support comprising a proximal pillow wherein the proximal pillow has a central portion, a frontal leg portion, and a rear leg portion wherein the frontal and rear leg portions have proximal ends coupled to the central portion and distal ends spaced from the central portion and wherein the frontal and rear leg portions and the central portion together define a reception area for receiving the shoulder and upper torso of the individual, a distal pillow wherein the distal pillow has a central portion, a frontal leg portion, and a rear leg portion wherein the frontal and rear leg portions have proximal ends coupled to the central portion and distal ends spaced from the central portion and wherein the frontal and rear leg portions and the central portion together define a reception area for receiving the arm and shoulder of the individual, an upper connector operative to couple the central portions of the proximal and distal pillows, a first lower connecting strap with a first end connected to the frontal leg portion of the proximal pillow and a second end retained relative to the frontal leg portion of the distal pillow, a second lower connecting strap with a first end connected to the rear leg portion of the proximal pillow and a second end retained relative to the rear leg portion of the distal pillow, and wherein the retaining strap has a first end coupled to the left shoulder support and a second end coupled to the right shoulder support;

whereby the proximal pillow can be disposed to receive the shoulder and upper torso of the individual, the distal pillow can be disposed to receive the arm or shoulder of the individual, and the shoulder support structure with the proximal and distal pillows can be retained relative to the shoulder of the individual.

22. The shoulder support structure of claim 21, further comprising a connector operative to form the distal pillow that cooperates with the proximal pillow to form the left shoulder support into a closed loop.

23. The shoulder support structure of claim 22, wherein the connector comprises a selective connector for selectively forming the distal pillow that cooperates with the proximal pillow to form the left shoulder support into a closed loop.

24. The shoulder support structure of claim 21, wherein each of the first and second lower connecting straps are individually adjustable in length to permit an adjustment of a maximum separation between the frontal and rear leg portions of the proximal and distal pillows permitted by the first and second lower connecting straps.

25. The shoulder support structure of claim 21, wherein the retaining strap has a first end coupled to the proximal pillow that cooperates with the distal pillow to form the left shoulder support, a body portion for encircling the individual, and a second end coupled to the proximal pillow that cooperates with the distal pillow to form the left shoulder support.

26. The shoulder support structure of claim 25, wherein the first end of the retaining strap is coupled to a frontal, upper portion of the proximal pillow that cooperates with the distal pillow to form the left shoulder support and wherein the second end of the retaining strap is coupled to a rear, upper portion of the proximal pillow that cooperates with the distal pillow to form the left shoulder support whereby the retaining strap comprises an upper retaining strap and further comprising a lower retaining strap with a first end coupled to the frontal leg portion of the proximal pillow that cooperates with the distal pillow to form the left shoulder support and a second end coupled to the rear leg portion of the proximal pillow that cooperates with the distal pillow to form the left shoulder support.

27. The shoulder support structure of claim 21, wherein the retaining strap comprises a front retaining strap with a first end coupled to a frontal portion of the left shoulder support and a second end coupled to a frontal portion of the right shoulder support whereby the retaining strap comprises a front strap and further comprising a back strap with a first end coupled to a rear portion of the left shoulder support and a second end coupled to a rear portion of the right shoulder support.

* * * * *